US005303438A

United States Patent [19]

Walker

[11] Patent Number: 5,303,438

[45] Date of Patent: Apr. 19, 1994

[54] INTEGRAL POLYETHYLENE ROTATION MOLDED CHILDREN'S COT

[76] Inventor: Leon Walker, 4819 S. Greenwood Ave., Chicago, Ill. 60615

[21] Appl. No.: 24,747

[22] Filed: Feb. 23, 1993

[51] Int. Cl.[5] ..... A47D 7/00

[52] U.S. Cl. ..... 5/652; 5/8; 5/110; 5/308

[58] Field of Search ..... 5/8, 110, 308, 400, 5/652, 655; 4/530, 584, 585, 589, 593

[56] References Cited

U.S. PATENT DOCUMENTS

| | | | |
|---|---|---|---|
| D. 182,957 | 6/1958 | Harris et al. . | |
| D. 243,213 | 2/1977 | Kormos . | |
| D. 288,636 | 3/1987 | McLaren . | |
| 3,097,368 | 7/1963 | Collins . | |
| 3,835,482 | 9/1974 | Tersch | 4/585 X |
| 4,234,977 | 11/1980 | Snow | 5/110 |
| 4,234,978 | 11/1980 | Snow | 5/111 |
| 4,530,123 | 7/1985 | Mathou . | |
| 4,583,252 | 4/1986 | McCourt | 5/110 X |
| 4,879,774 | 11/1989 | Sanders . | |
| 5,003,649 | 4/1991 | Kelly . | |
| 5,068,935 | 12/1991 | Hagopian | 5/400 X |

FOREIGN PATENT DOCUMENTS

| | | | |
|---|---|---|---|
| 563139 | 6/1975 | Switzerland | 5/400 |
| 1308852 | 3/1973 | United Kingdom | 5/400 |

OTHER PUBLICATIONS

*Constructive Playthings,* 1992–Furniture–rest and relaxation (pp. 4–5).

*Beckley–Cardy Quarterly,* Apr. 1992–Early Childhood--Products Highlights (p. 31).

*Lake Shore Learning Materials,* 1992–Cots–PlayLearn (p. 13).

*Primary Examiner*—Michael F. Trettel

*Attorney, Agent, or Firm*—Patula & Associates

[57] ABSTRACT

A strong, lightweight, one-piece rotation molded children's cot having a base, four side walls, and a cot surface. The cot surface contains grooves which serve to collect liquid waste from a child's bed-wetting accident, so as to sanitarily separate the child from the waste. The cot also is provided with a storage compartment as well as hand grips for easy moving and cleaning. The cots may be stacked for storage.

16 Claims, 3 Drawing Sheets

INTEGRAL POLYETHYLENE ROTATION MOLDED CHILDREN'S COT

This invention relates to a novel children's cot especially for use as a child care center sleeping cot.

BACKGROUND OF THE INVENTION

In kindergartens, preschools, day care centers and other similar places, children often are allowed or even required to take naps. Traditionally, children are provided with various types of mats or cots to sleep on. There are, however, several disadvantages of these traditional mats or cots.

Floor mats can be uncomfortable and can subject the children to cold air or drafts. Additionally, mats which are not liquidproof are subject to odors and generally unsanitary conditions as well as difficult and costly clean up problems should the child have a toilet accident ("wet the bed"). Mats which are liquidproof have their own sanitary problems in that liquid waste tends to run off the mat and onto the floor.

Traditional cots are costly and sometimes require assembly. The multiple parts, such as screws or other fasteners may come loose and present a hazard to the child. The child may also attempt to dismantle the cot if it has screws or other fasteners. Also, cot sleeping surfaces may become worn and may require replacing. Again, if the surface is not liquidproofed, sanitary and cleaning problems arise. If the surface is liquidproof, liquid waste may either form a puddle thereon or run off onto the floor. Further, traditional cots can be cumbersome and a teacher or caregiver cannot place or put away a large number of cots while at the same time watch and care for the children.

U.S. Pat. Nos. 4,234,977 and 4,234,978 issued to Snow disclose one attempt to alleviate these problems. Snow discloses a one or two piece molded cot having a contoured sleeping surface with four supporting inner walls which define a supporting cradle which is liquidproof. However, while Snow's cot may have some benefits, the cot is uncomfortable to sleep on and the above-mentioned significant sanitary problem still exists. Namely, Snow makes no provisions in the cot to collect and hold waste away from a child and/or mat. Further, Snow's cot does not have hand grips to facilitate movement of the cot by the children themselves. The present invention solves these and other problems and/or disadvantages by providing novel collecting and storing means in the cot's surface.

BRIEF SUMMARY OF THE INVENTION

The invention consists of a one-piece rotation molded child's cot comprising a base, a cot surface, and four side walls surrounding the cot surface and extending downward to the base. The cot surface contains several grooves for collecting liquid waste from the child. The length side walls contain hand grips. The corners of the cot are provided with integral footed or flared supports. A storage compartment for a child's shoes or other articles is also provided at the head of the cot. Additionally, there is an area on the cot to place a child's name.

Accordingly, it is the principle object of the present invention to provide an improved child's cot.

It is a further object of the invention to provide a child's cot that is light weight yet very strong and durable and has hand grips so that a small child may move the cot to a desired location.

It is also an object of the invention to provide a one-piece child's cot that is safe, maintenance free, and virtually indestructible.

It is an additional object of the present invention to provide an integral rotation molded child's cot which is designed to be easy to clean and sanitary when a child has a bed-wetting accident.

It is another object of the invention to provide a child's cot which is aesthetically pleasing, orthopedic, economic, safe and stackable.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENT OF THE PRESENT INVENTION

Figure 1:
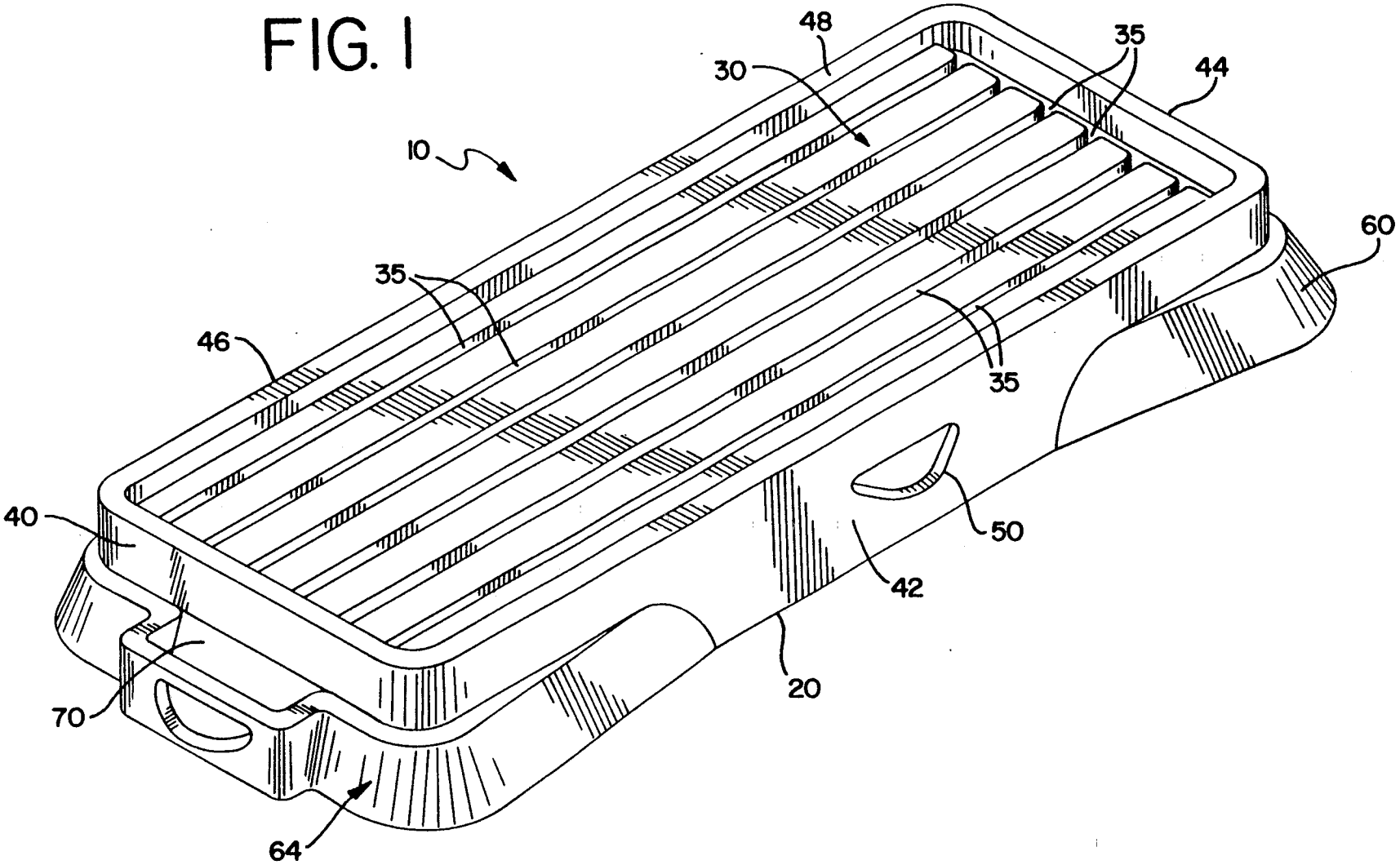
FIG. 1 is a perspective view of the preferred embodiment of the present invention.

While the invention is susceptible of embodiment in many different forms, there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

FIGS. 1–6 illustrate the present invention 10 comprising base 20, cot surface 30 having grooves 35, side walls 40, 42, 44, and 46, hand grips 50, flared supports 60, 62, and 64, and compartment 70.

FIG. 1 is a perspective view of the preferred embodiment of the present invention 10. As shown in FIG. 1, invention 10 is a one-piece molded child's cot comprising a base 20, side walls 40, 42, 44, and 46, and a rigid cot surface 30. The side walls extend higher than cot surface 30, thereby forming a shallow recess which is designed to hold a liquidproof mattress or other suitable mat. The side walls 40, 42, 44, and 46 are further defined as having an exterior face, an interior face, and a top surface 48. Side wall 42 is parallel to side wall 46 and side wall 40 is parallel to side wall 44. The four walls meet at rounded corners to form a substantially rectangular shape. The top surface 48 is level and flat so as to allow a number of cots to be stacked.

At the four rounded corners, approximately half way down from the top surface 48, the side walls jut out and then descend at an angle to the base 20, thereby forming flared supports 60, 62 (not shown), and 64. These flared supports add strength to invention 10, and also prevent the cot from being easily tipped over.

Flared supports 60 and 62 extend around the corners at side wall 44 but end short of connecting at the middle of side wall 44. Flared support 64, however, is continuous from its beginning at side wall 42, extending completely across side wall 40, until its end at side wall 46. At the middle of side wall 40, flared support 64 breaks away from side wall 40 to form a compartment 70 for holding objects or items of a user.

Cot surface 30 contains a number of grooves 35 therein. Cot surface 30 is illustrated as having seven longitudinal grooves (see FIG. 2) parallel to side walls 42 and 46, and meeting with two end grooves running parallel to and along side walls 40, 44. However, it should be understood that any suitable number of grooves of any shape or orientation could be used in cot surface 30. The grooves 35 are of sufficient depth so that liquid waste grooves of any shape or orientation could be used in cot surface 30. The grooves 35 are of sufficient depth so that liquid waste collecting in the grooves cannot contact a child and/or mattress resting on the rigid cot surface 30. If a child using invention 10 has a bed-wetting accident, the fluid waste will run down and over the sides of the mattress and collect in the grooves 35, thereby keeping as much liquid waste away from the child as possible. The grooves 35 act like a reservoir to collect and store liquid waste and separate the waste from the child and/or sleeping mat. The waste can then be easily wiped up or washed away. The grooves 35 further provide additional stability and support to the cot, since the vertical side portions of the grooves act similar to I-beams to give added strength and rigidity to cot surface 30 and the overall invention 10.

Also seen in FIG. 1 is hand grip 50 formed in side wall 42. Hand grip 50 is provided to make the cot easy to move and clean. A hand grip is also provided in side wall 46.

Figure 2:
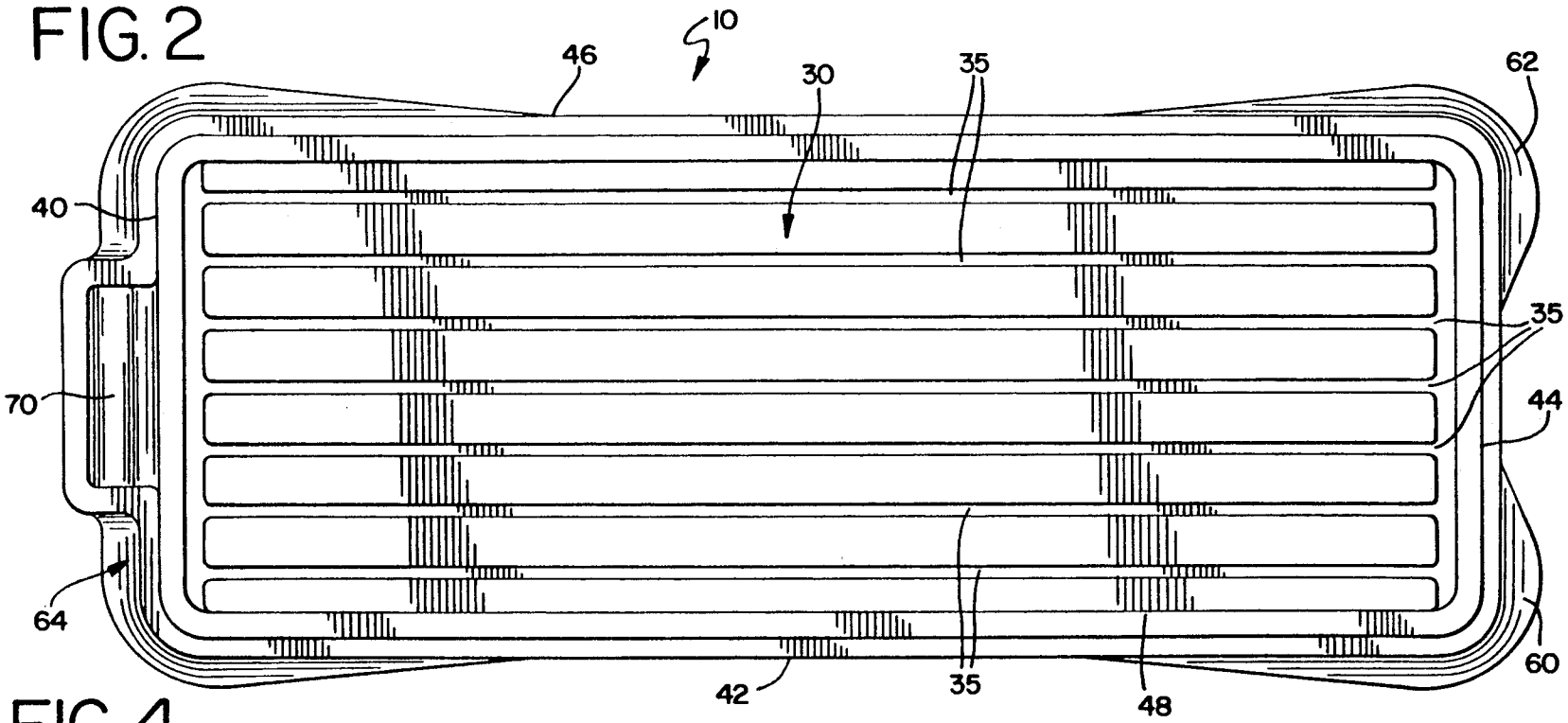
FIG. 2 is a top view of the present invention of FIG. 1.

FIG. 2 is a top view of invention 10. Cot surface 30 is shown as having a plurality of longitudinal grooves 35 as well as two end grooves running along side walls 40, 44. Flared supports 60 and 62 are shown extending around the corners of side wall 44 but stopping short of connecting with another flared support. Flared support 64 is shown extending completely across side wall 40, around the corners of side wall 40, and ending on side walls 42 and 46. At the middle of side wall 40, flared support 64 is shown to have broken away from side wall 40 to form compartment 70.

Figure 3:
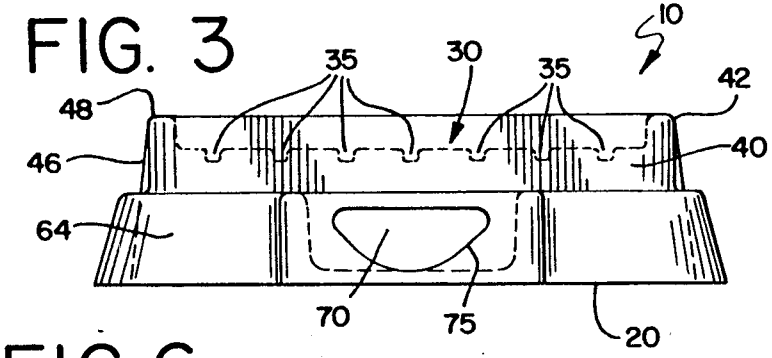
FIG. 3 is a front view of the present invention.

FIG. 3 is a front view of invention 10 looking in the direction of flared support 64. Compartment 70 is depicted as having an opening 75 which may serve as an additional hand grip. Also seen in FIG. 3 are base 20, side walls 40, 42, and 46 having top surface 48, and cot surface 30 having grooves 35.

Figure 4:
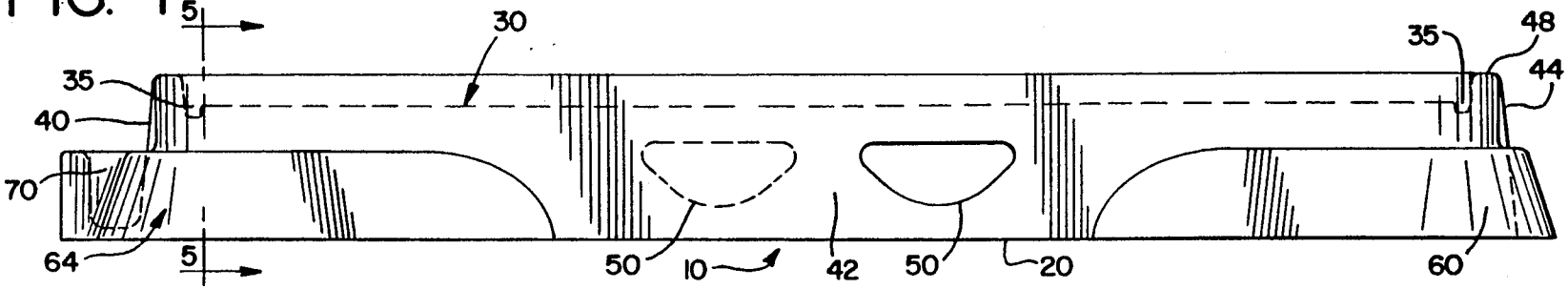
FIG. 4 is a side view of the present invention.

FIG. 4 is a side view of invention 10 looking in the direction of side wall 42. FIG. 4 depicts base 20, side walls 40, 42, and 44 having top surface 48, hand grips 50, flared supports 60 and 64, compartment 70, and cot surface 30 having grooves 35.

Figure 5:
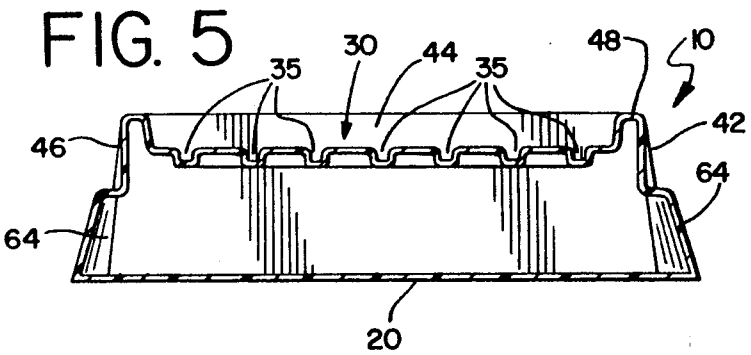
FIG. 5 is a cross-sectional view of the present invention taken along line 5—5 of FIG. 4.

FIG. 5 is a cross-sectional view of invention 10 taken along line 5—5 of FIG. 4. FIG. 5 shows base 20, cot surface 30 having grooves 35, side walls 42, 44, and 46 having top surface 48, and flared support 64.

Figure 6:
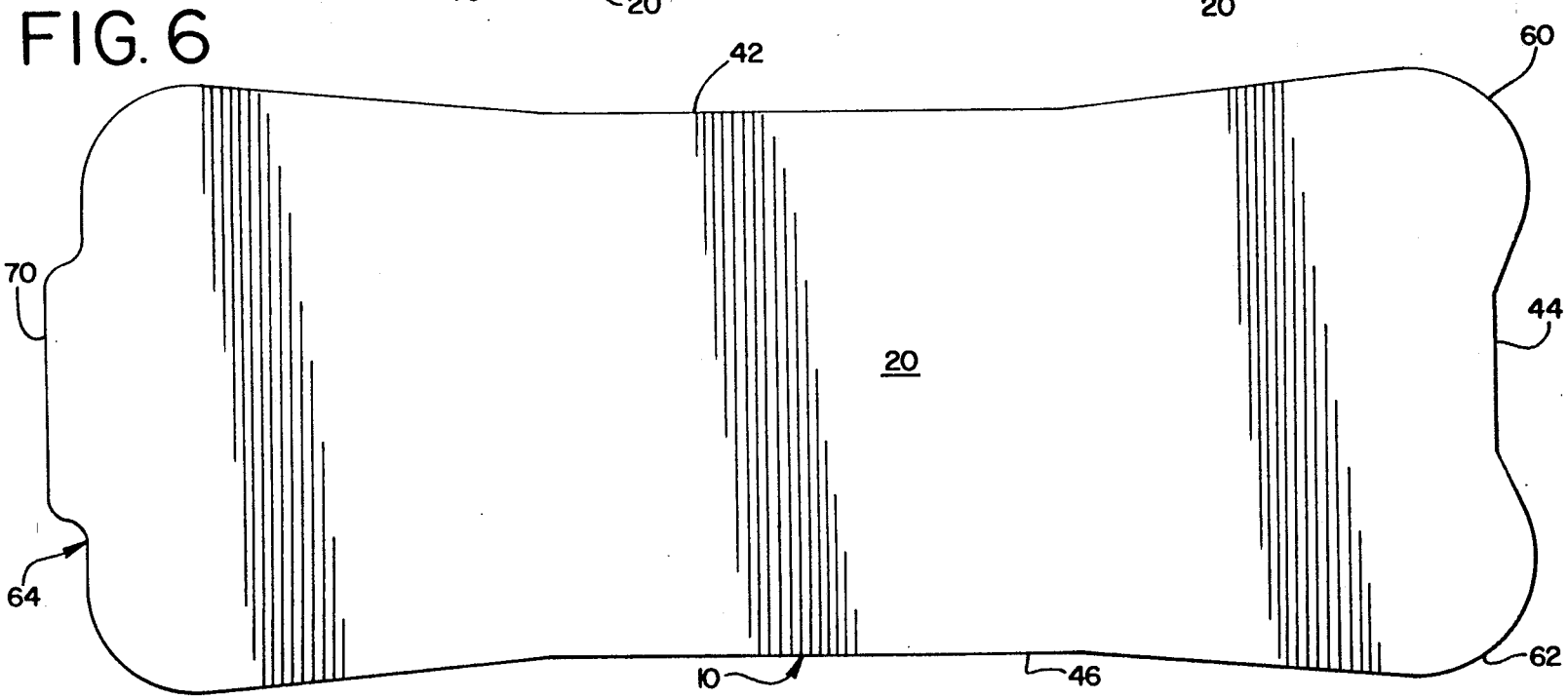
FIG. 6 is a bottom view of the present invention.

FIG. 6 is a bottom view of invention 10 showing base 20. Base 20 is connected to side walls 42, 44, and 46, flared supports 60, 62, and 64, as well as compartment 70.

Invention 10 is constructed from polyethylene plastic or other suitable material and utilizes a rotational molding procedure that allows the invention to be made in one continuous piece. Although rotation molding is conventional, it is believed that no one has produced a cot in this manner. The creation of invention 10 by way of rotation molding is as follows. Polyethylene in powdered or liquid form is placed in a closed mold of the cot. The mold is then continuously rotated about its vertical and horizontal axes to uniformly distribute the polyethylene over the inside surface of the mold. During rotation, the mold first passes through a heating oven. The polyethylene becomes fused or cured. The rotating mold then passes into a cooling chamber where the polyethylene solidifies. The mold is then opened and the cot is removed. This economical process produces a seamless, strong, one-piece, hollow cot having uniform wall thickness. This novel method of production of a children's cot is considered novel because it provides the benefits detailed above The invention 10 is lightweight yet very durable and strong, equipped to safely accommodate a child of up to 150 lbs. It should be understood the cot could be made any size and thickness to accommodate a child or even adult of any weight. There are no parts to assemble or fasteners to replace making invention 10 extremely safe around children. The invention is very aesthetically pleasing and can be manufactured in several different colors.

The flat cot surface provides the orthopedic support often recommended by doctors. A liquidproof, high density foam mattress may be added for extra comfort. The mattress fits into the recess formed by the side walls and rests above the grooves.

The invention is easily stackable and can be stored in a relatively small area in the schoolroom. The children themselves can carry and place the cots on the floor and put them away with little difficulty by using the hand grips. This also teaches the children responsibility and cooperation.

Several accessories can be used including fitted and flat sheets, blankets and pillows. The accessories are washable and the fitted sheets are easy to remove and have no elastic which can become twisted and worn from repeated washings and dryings.

The invention has been designed so that if a child has a toilet accident while napping, liquid body waste will not go through the bedding and onto the flooring under the cot or will not rest in a puddle on the cot surface. The liquid will run off the mattress and collect in the grooves of the cot. For clean up, the care giver need only change the sheet and wipe the mattress and cot surface off with a damp cloth. For a more extensive clean up, the entire mattress and bed can be hosed off with no damage to either.

As an additional safety measure, the invention 10 is low to the floor. If a child were to fall out of the cot, the distance to the floor is very short so that little or no injury would result.

It is to be understood that the embodiments herein described are merely illustrative of the principles of the present invention. Various modifications may be made by those skilled in the art without departing from the spirit or scope of the claims which follow.

I claim:

1. A one piece children's cot comprising:

a base;

a surface parallel to the base and supported above the base;

four side walls forming a substantially rectangular structure having rounded corners with flared supports; and said surface containing at least one groove.

2. The cot of claim 1, wherein said four side walls are defined as having an exterior face, an interior face, and a top surface.

3. The cot of claim 2, wherein said top surface is flat so as to allow for stacking.

4. The cot of claim 1, wherein said side walls extend higher than said surface, thereby defining a shallow recess.

5. The cot of claim 1, wherein one of said flared supports breaks away from said side walls to form a storage compartment.

6. The cot of claim 1, wherein a plurality of hand grips are provided in said side walls.

7. The cot of claim 1, wherein said cot is constructed from polyethylene plastic.

8. The cot of claim 1, wherein said cot is rotation molded.

9. A one piece children's cot comprising:

a planar base;

four side walls extending up from said base defining a substantially rectangular structure having rounded corners, said side walls having an exterior face, an interior face, and a flat top surface;

a planar surface supported parallel to said base by said side walls; and means for collecting liquid in said planar surface.

10. The cot of claim 9, wherein said means for collecting liquid is a plurality of grooves.

11. The cot of claim 10, wherein said side walls are further defined by flared supports at said corners, said flared supports slope downward and outward to said base.

12. The cot of claim 9, wherein said cot is rotation molded from polyethylene plastic.

13. The cot of claim 9, wherein said side walls extend higher than said planar surface so as to define a shallow recess capable of receiving accessories.

14. The cot of claim 9, wherein a storage compartment is formed in one of said flared supports, said compartment and two of said side walls containing hand grips.

15. A one piece children's cot comprising:

a planar base;

two parallel longitudinal side walls;

two short side walls;

a planar cot surface supported by said side walls;

said longitudinal side walls connect to said short side walls at rounded corners to form a substantially rectangular shape, said side walls defined by an exterior face, an interior face, and a flat top surface, said side walls extending higher than said cot surface thereby forming a shallow recess, said side walls further defined by flared supports at said corners;

a plurality of grooves deposed in said cot surface to collect liquid from a child's bed-wetting accident, so as to sanitarily separate the liquid from the child and to provide strength to said planar cot surface;

a storage compartment formed in one of said flared supports; and hand grips formed in said storage compartment and said longitudinal sides.

16. The cot of claim 15, wherein said cot is rotation molded from polyethylene plastic.

* * * * *